US009475559B2

(12) United States Patent
Czarnowski et al.

(10) Patent No.: US 9,475,559 B2
(45) Date of Patent: Oct. 25, 2016

(54) FOOT OPERATED PROPULSION SYSTEM FOR WATERCRAFT

(71) Applicant: Hobie Cat Company, Oceanside, CA (US)

(72) Inventors: James Taylor Czarnowski, Fallbrook, CA (US); Gregory Scott Ketterman, Oceanside, CA (US); Jason Christopher Kardas, Vista, CA (US); Philip James Dow, Oceanside, CA (US); Graeme Stuart Wicks, Oceanside, CA (US); Drew William Brackett, Oceanside, CA (US)

(73) Assignee: Hobie Cat Company, Oceanside, CA (US)

( * ) Notice: Subject to any disclaimer, the term of this patent is extended or adjusted under 35 U.S.C. 154(b) by 149 days.

(21) Appl. No.: 14/318,472

(22) Filed: Jun. 27, 2014

(65) Prior Publication Data

US 2015/0011134 A1 Jan. 8, 2015

Related U.S. Application Data

(60) Provisional application No. 61/842,582, filed on Jul. 3, 2013.

(51) Int. Cl.
*B63H 1/36* (2006.01)
*B63H 16/18* (2006.01)
(Continued)

(52) U.S. Cl.
CPC ..... *B63H 1/36* (2013.01); *B63B 35/71* (2013.01); *B63B 35/79* (2013.01); *B63H 16/12* (2013.01); *B63H 16/18* (2013.01)

(58) Field of Classification Search
CPC ..... A63B 2022/0051; A63B 2022/0053; A63B 22/0056; A63B 22/0058; A63B 21/0084; A63B 22/205; A63B 22/04; B63H 1/36; B63H 1/37; B63H 16/08; B63H 16/12; B63H 16/16; B63H 16/18
USPC ..... 440/13–16, 21, 25, 32
See application file for complete search history.

(56) References Cited

U.S. PATENT DOCUMENTS 35,451 A 6/1862 Johnson
53,415 A 3/1866 Cole
(Continued)

FOREIGN PATENT DOCUMENTS

DE 10128714 A1 * 12/2002 ..... A63B 21/0084
GB 174017 A 1/1922
(Continued)

OTHER PUBLICATIONS

Howe, Peter J., "Penguin Power Bids to Challenge the Propeller", The Boston Globe, May 12, 1997, p. C1.

*Primary Examiner* — Ajay Vasudeva
(74) *Attorney, Agent, or Firm* — Joseph E. Mueth, Esq.

(57) ABSTRACT

A device for insertion in watercraft including propulsion means comprising a pair of flappers which oscillate through an arcuate path in a transverse direction with respect to the central longitudinal dimension of the watercraft. As input force is applied, the flappers twist to form an angle of attack for providing forward thrust. The means for applying propulsive force includes a pair of pedals, and further includes pedal cranks operatively associated with the propulsion means, the fore ends of the pedals being pivotally attached to a fixed point.

13 Claims, 22 Drawing Sheets

(51) Int. Cl.

| | |
|---|---|
| ***B63B 35/71*** | (2006.01) |
| ***B63B 35/79*** | (2006.01) |
| ***B63H 16/08*** | (2006.01) |

(56) References Cited

U.S. PATENT DOCUMENTS

| | | | | |
|---|---|---|---|---|
| 1,826,507 | A | 10/1931 | Crosby | |
| 2,158,349 | A | 5/1939 | Allen | |
| 2,286,914 | A | 3/1941 | Knapp | |
| 2,644,177 | A | 7/1953 | Stanley | |
| 2,873,713 | A | 12/1955 | Baastrup | |
| 2,948,255 | A | 8/1960 | Sbrana | |
| 3,032,001 | A | 8/1960 | Kiker, Jr. | |
| 3,095,850 | A | 7/1963 | Stolzer | |
| 3,211,125 | A | 10/1965 | Yarbrough | |
| 3,598,076 | A | 8/1971 | Saxton | |
| 3,695,211 | A | 10/1972 | Gross | |
| 3,726,245 | A | 4/1973 | Critcher | |
| 3,802,366 | A | 4/1974 | Mankawich | |
| 3,828,719 | A | 8/1974 | Cooke | |
| 4,027,614 | A | 6/1977 | Jones | |
| 4,228,750 | A | 10/1980 | Smith et al. | |
| 4,318,700 | A | 3/1982 | Price | |
| 4,474,502 | A | 10/1984 | Daoud | |
| 4,490,119 | A | 12/1984 | Young | |
| 4,511,338 | A | 4/1985 | Fanelli | |
| 4,615,291 | A | 10/1986 | Jones | |
| 4,648,846 | A | 3/1987 | Hsu | |
| 4,676,755 | A | 6/1987 | Yagan | |
| 4,688,815 | A | 8/1987 | Smith | |
| 4,768,454 | A | 9/1988 | Selken | |
| 4,891,024 | A | 1/1990 | Benjamin | |
| 4,936,802 | A * | 6/1990 | Ueno | B63H 1/36 440/13 |
| 4,943,251 | A | 7/1990 | Lerach et al. | |
| 4,960,396 | A | 10/1990 | Stolzer | |
| 4,968,274 | A | 11/1990 | Gregory | |
| 4,981,099 | A | 1/1991 | Holder | |
| 5,021,015 | A | 6/1991 | Wang | |
| 5,054,410 | A | 10/1991 | Scarborough | |
| 5,090,928 | A | 2/1992 | Rybczyk | |
| 5,102,359 | A | 4/1992 | Hinds | |
| 5,168,824 | A | 12/1992 | Ketterman | |
| 5,183,422 | A | 2/1993 | Guiboche | |
| 5,194,024 | A | 3/1993 | Shiraki | |
| 5,295,927 | A | 3/1994 | Easley et al. | |
| 5,309,859 | A | 5/1994 | Miller | |
| 5,453,031 | A | 9/1995 | Gagnier | |
| 5,460,551 | A | 10/1995 | Beres | |
| 5,513,900 | A | 5/1996 | Iglesias | |
| D374,421 | S * | 10/1996 | Lekhtman | D12/300 |
| 5,580,288 | A | 12/1996 | Marine | |
| 5,584,732 | A | 12/1996 | Owen | |
| 5,591,107 | A * | 1/1997 | Rodgers, Jr. | A63B 71/0622 482/51 |
| 5,622,403 | A | 4/1997 | Gonda | |
| 5,643,020 | A | 7/1997 | Harris | |
| 5,651,706 | A | 7/1997 | Kasper | |
| 5,673,641 | A | 10/1997 | Sournat et al. | |
| 5,775,763 | A | 7/1998 | Glinter et al. | |
| 6,022,249 | A * | 2/2000 | Ketterman | B63H 1/36 400/21 |
| 6,024,041 | A | 2/2000 | Eglais | |
| 6,065,422 | A | 5/2000 | Davidson et al. | |
| 6,077,134 | A | 6/2000 | Lam | |
| 6,112,692 | A | 9/2000 | Lekhtman | |
| 6,165,029 | A | 12/2000 | Lu | |
| 6,165,030 | A | 12/2000 | Lewis | |
| 6,210,242 | B1 | 4/2001 | Howard et al. | |
| 6,311,632 | B1 | 11/2001 | Noel, Jr. | |
| 6,468,118 | B1 * | 10/2002 | Chen | B63H 1/36 114/61.1 |
| 6,478,639 | B1 | 11/2002 | Covell, III | |
| 6,578,507 | B1 | 6/2003 | Bergmark | |
| 6,675,735 | B1 | 1/2004 | Bourn | |
| 6,729,258 | B1 | 5/2004 | Fuglsang et al. | |
| 6,736,084 | B2 | 5/2004 | McDonough et al. | |
| 6,827,396 | B1 | 12/2004 | Jewell | |
| 6,855,016 | B1 | 2/2005 | Jansen | |
| 6,883,450 | B2 | 4/2005 | Kingsbury | |
| 6,905,379 | B1 | 6/2005 | Jackson | |
| 6,925,955 | B1 | 8/2005 | Brooks | |
| 6,997,765 | B1 | 2/2006 | McGuiness | |
| 7,300,324 | B2 | 11/2007 | Garwood | |
| 7,371,138 | B2 | 5/2008 | Spass | |
| 7,430,976 | B2 | 10/2008 | Ketterman et al. | |
| 7,549,902 | B2 | 6/2009 | Jansen | |
| 7,568,442 | B2 | 8/2009 | Kruppa | |
| 7,568,443 | B2 | 8/2009 | Walker | |
| 7,637,221 | B1 | 12/2009 | Sinden | |
| 7,637,791 | B2 | 12/2009 | Ketterman et al. | |
| 7,644,672 | B2 | 1/2010 | Welbourn | |
| 7,699,262 | B2 | 4/2010 | Filipek | |
| 7,743,720 | B1 | 6/2010 | Salani | |
| 8,056,983 | B2 | 11/2011 | Adams et al. | |
| 8,069,801 | B2 | 12/2011 | Ott et al. | |
| 8,109,221 | B2 | 2/2012 | Graf et al. | |
| 8,167,667 | B2 * | 5/2012 | Sturm | B63B 7/085 440/21 |
| 8,210,114 | B2 | 7/2012 | Nysether et al. | |
| 8,276,536 | B2 | 10/2012 | Winsky et al. | |
| 8,387,940 | B2 | 3/2013 | Gros | |
| 8,408,155 | B2 | 4/2013 | Sancoff et al. | |
| 8,651,576 | B2 | 2/2014 | Farber | |
| 8,720,354 | B2 | 5/2014 | Ketterman et al. | |
| 8,986,057 | B2 * | 3/2015 | Catarina | B63B 1/12 440/21 |
| 8,992,272 | B1 * | 3/2015 | Malakiman | B63H 16/18 440/21 |
| 9,027,501 | B2 * | 5/2015 | Wood | B63B 29/04 114/363 |
| 9,180,949 | B2 * | 11/2015 | Hansen | B63H 16/12 |
| 2002/0096098 | A1 | 7/2002 | Kingsbury | |
| 2006/0202533 | A1 | 9/2006 | Goodman | |
| 2008/0060569 | A1 | 3/2008 | Howard | |
| 2008/0283105 | A1 | 11/2008 | Dubose, III | |
| 2008/0293312 | A1 | 11/2008 | Scott | |
| 2009/0038526 | A1 | 2/2009 | Walton | |
| 2009/0038529 | A1 | 2/2009 | Walton | |
| 2011/0287674 | A1 | 11/2011 | Jemt | |
| 2012/0017821 | A1 | 1/2012 | Mcdonough | |
| 2012/0048165 | A1 | 3/2012 | Westerman | |
| 2016/0009345 | A1 * | 1/2016 | Gray | B63B 35/79 441/74 |

FOREIGN PATENT DOCUMENTS

| | | | | |
|---|---|---|---|---|
| GB | 452719 | | 8/1936 | |
| GB | 2270283 | A | 3/1994 | |
| JP | 52-033290 | | 3/1977 | |
| JP | 01-144198 | | 10/1989 | |
| JP | 03-035897 | | 4/1991 | |
| JP | 2008094168 | A | 4/2008 | |
| WO | 99/61306 | A1 | 2/1999 | |
| WO | WO 2008087044 | A1 * | 7/2008 | B63H 16/12 |
| WO | 2011011006 | A1 | 1/2011 | |

* cited by examiner

FOOT OPERATED PROPULSION SYSTEM FOR WATERCRAFT

FIELD OF INVENTION

This invention relates to novel watercraft.

BACKGROUND OF INVENTION

There exists a wide array of recreational watercraft including paddle boards and boats such as kayaks. In one prior kayak, propulsion is provided while the operator is seated within a cockpit in the kayak with pedals positioned fore. However, this does not permit the opportunity for the operator to stand up or rest on an elevated seat located well above the upper extremity of the hull.

The present invention affords an entirely new sensation for the operator of a kayak, paddle board or other watercraft.

SUMMARY OF THE INVENTION

Briefly, this invention comprises a device adapted to be inserted in a watercraft comprising propulsion means extending below the water line carried by a support member, said propulsion means comprising a pair of flexible flappers each adapted to oscillate through an arcuate path in a generally transverse direction with respect to the central longitudinal dimension of said watercraft, one fin rotating in one direction and the other fin in the opposite direction, and means operatively associated with said propulsion means for applying input force to said propulsion means whereby as input force is applied, said flexible flappers can twist to form an angle of attack for providing forward thrust with respect to the longitudinal dimension of the watercraft while moving in both directions along said arcuate path, wherein said means for applying input force comprises a pair of pedals coupled to said fins such that as one pedal moves down the other moves up, the fore ends of the pedals being pivotally attached so as to pivot about an essentially horizontal axis essentially perpendicular to the center line of the watercraft and the aft ends of said pedals being free to pivot about said axis whereby an operator can apply step-wise force on the pedals.

Further, this invention comprises a device adapted to be inserted in a watercraft comprising propulsion means extending below the water line carried by a support member, said propulsion means comprising a pair of flexible flappers each adapted to oscillate through an arcuate path in a generally transverse direction with respect to the central longitudinal dimension of said watercraft, and means operatively associated with said propulsion means for applying input force to said propulsion means whereby as input force is applied, said flexible flappers can twist to form an angle of attack for providing forward thrust with respect to the longitudinal dimension of the watercraft while moving in both directions along said arcuate path, wherein said means for applying input force comprises a pair of pedals, and further including pedal cranks operatively associated with said propulsion means, the fore ends of the pedals being pivotally attached about a fixed point and the aft ends of said pedals being free to make rolling or sliding contact with said pedal cranks whereby an operator can apply force to the pedal cranks by applying step-wise force on the pedals.

The invention further comprises a device adapted to be inserted in a watercraft, said device comprising propulsion means extending below the water line carried by a support member, said propulsion means comprising a pair of flexible flappers each adapted to oscillate through an arcuate path in a generally transverse direction with respect to the central longitudinal dimension of said watercraft, and means operatively associated with said propulsion means for applying input force to said propulsion means whereby as input force is applied, said flexible flappers can twist to form an angle of attack for providing forward thrust with respect to the longitudinal dimension of the watercraft while moving in both directions along said arcuate path, wherein said means for applying input force comprises a pair of pedals, and further including pedal cranks operatively associated with said propulsion means, the fore ends of the pedals being pivotally affixed to an upper surface of said watercraft and the aft ends of said pedals being free to make rolling or sliding contact with said pedal cranks whereby an operator can apply force to the pedal cranks by applying step-wise force on the pedals.

The invention further comprises a novel watercraft having propulsion means extending below the water line carried by a support member, said propulsion means comprising a pair of flexible flappers each adapted to oscillate through an arcuate path in a generally transverse direction with respect to the central longitudinal dimension of said watercraft, and means operatively associated with said propulsion means for applying input force to said propulsion means whereby as input force is applied said flexible flappers can twist to form an angle of attack for providing forward thrust with respect to the longitudinal dimension of the watercraft while moving in both directions along said arcuate path wherein said means for applying propulsive force comprises a pair of pedals, and further including pedal cranks operatively associated with said propulsion means, the fore ends of the pedals being pivotally affixed to said support member and the aft ends of said pedals being free to make rolling or sliding contact with said pedal cranks whereby an operator can apply force to the pedal cranks by applying step-wise force on the pedals.

THE DRAWINGS

In the drawings:

FIG. 18 is a perspective view showing the pedals pivotally affixed to the fore end of the support member.

FIG. 19 is another perspective view of the embodiment of FIG. 18 taken from the lower front.

FIG. 20 is an enlarged view of the pivot point and attachment to the support member.

FIG. 21 is similar to FIG. 20, showing the end of the axle, with the mounting element removed.

FIG. 22 is a side view of the embodiment of FIGS. 18 to 21 showing the pivotally carried pedals and the connection of the cranks to the flappers.

DESCRIPTION OF THE PREFERRED EMBODIMENTS

Figure 1:
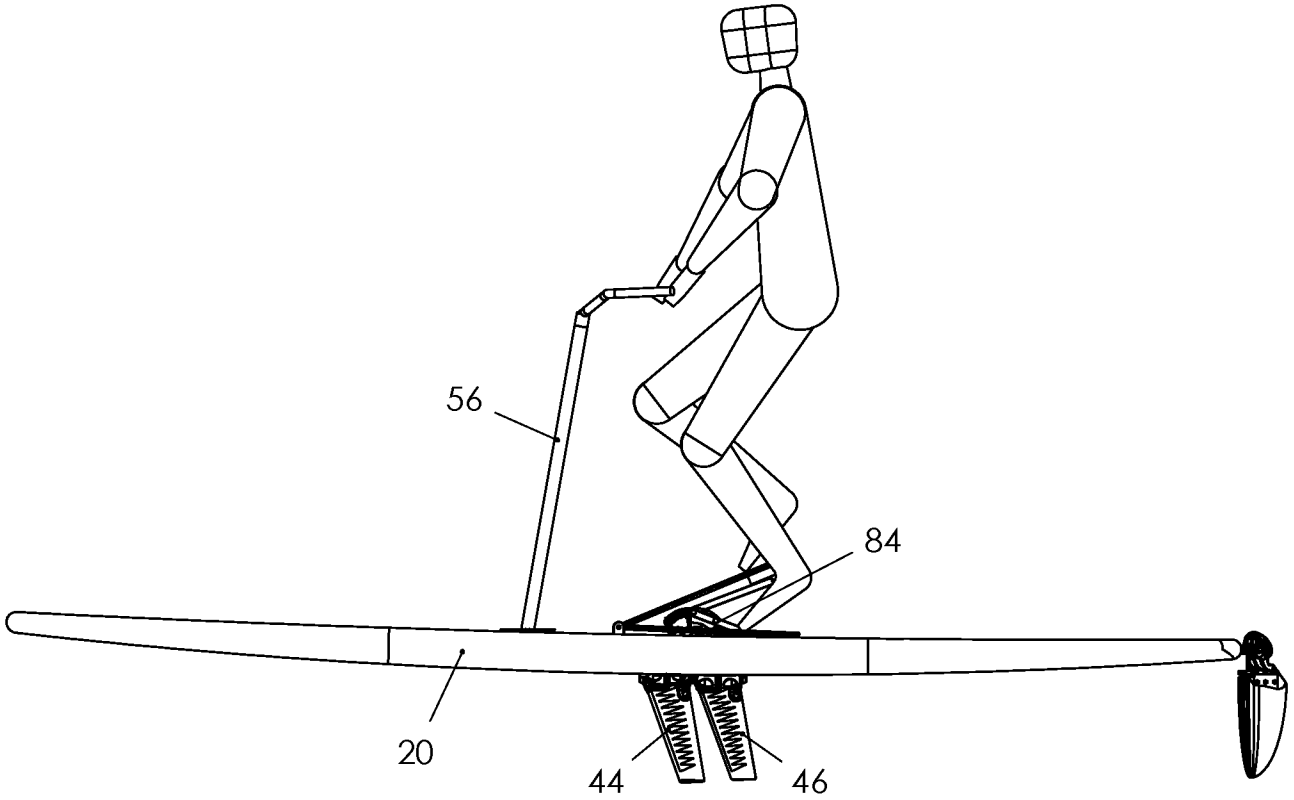
FIG. 1 is a side view of one embodiment of the invention comprising a paddle board wherein the operator is in the standing position and applies propulsive force by a stair-stepper motion.
Figure 2:
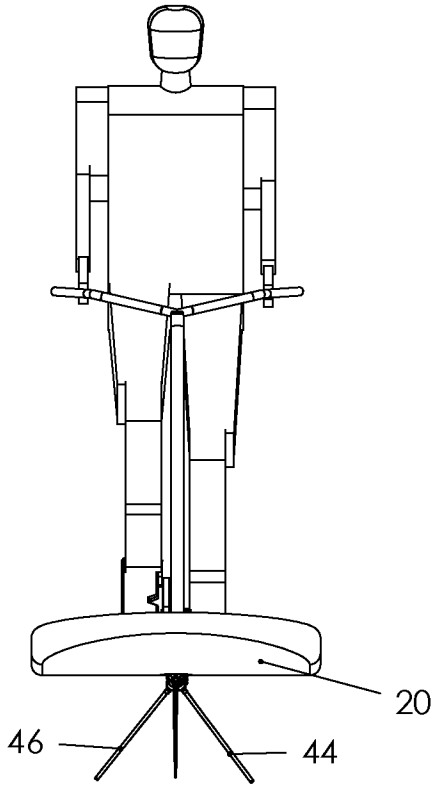
FIG. 2 is a front view of the paddle board of FIG. 1.
Figure 3:
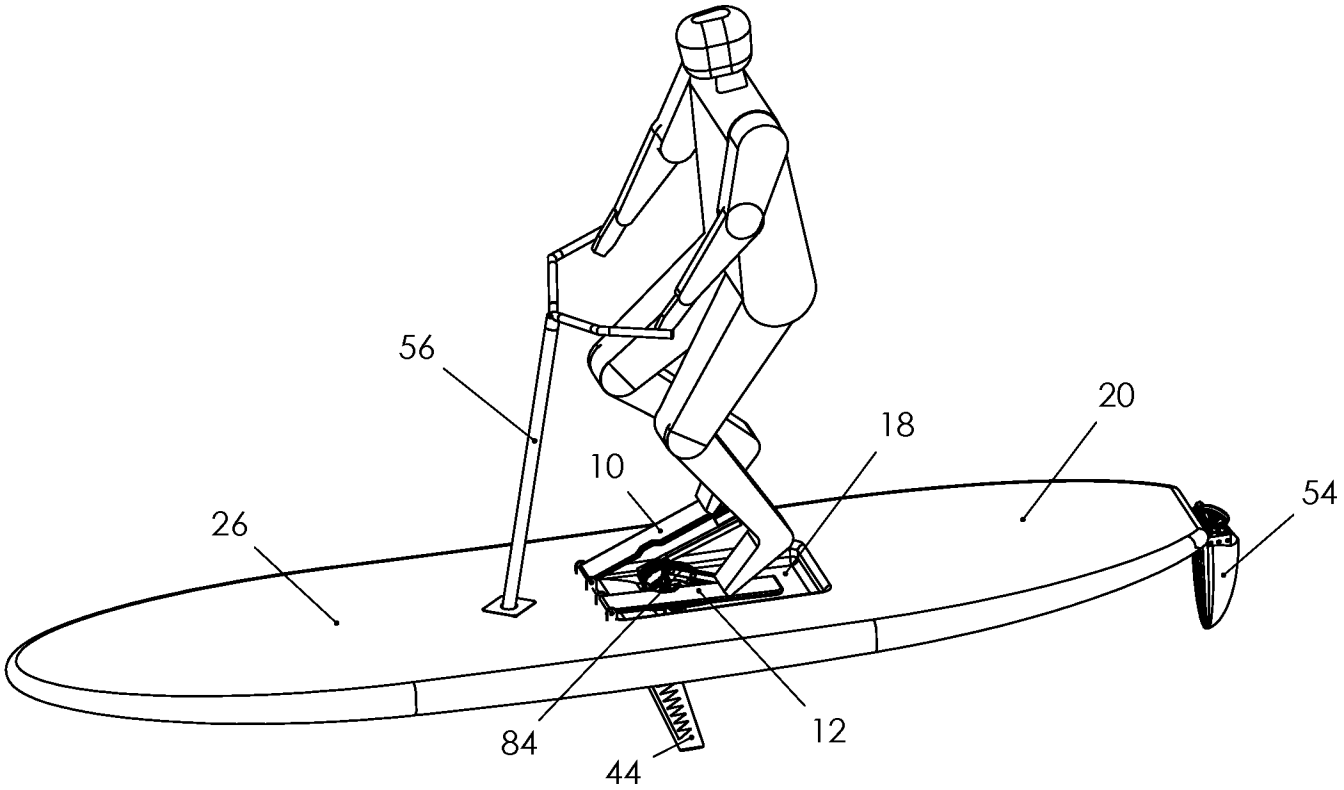
FIG. 3 is a perspective view of the paddle board of FIGS. 1 and 2 with the front of the board to the left.
Figure 4:
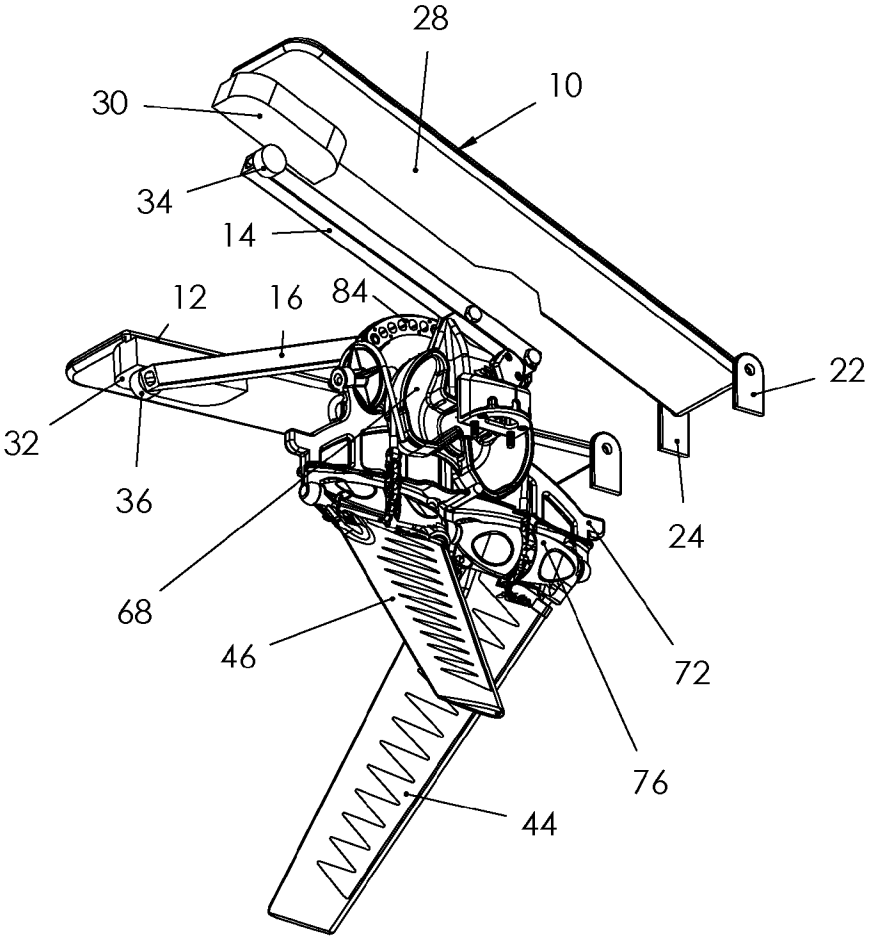
FIG. 4 is a bottom view from the side showing how the pedals and cranks operate the flappers.
Figure 5:
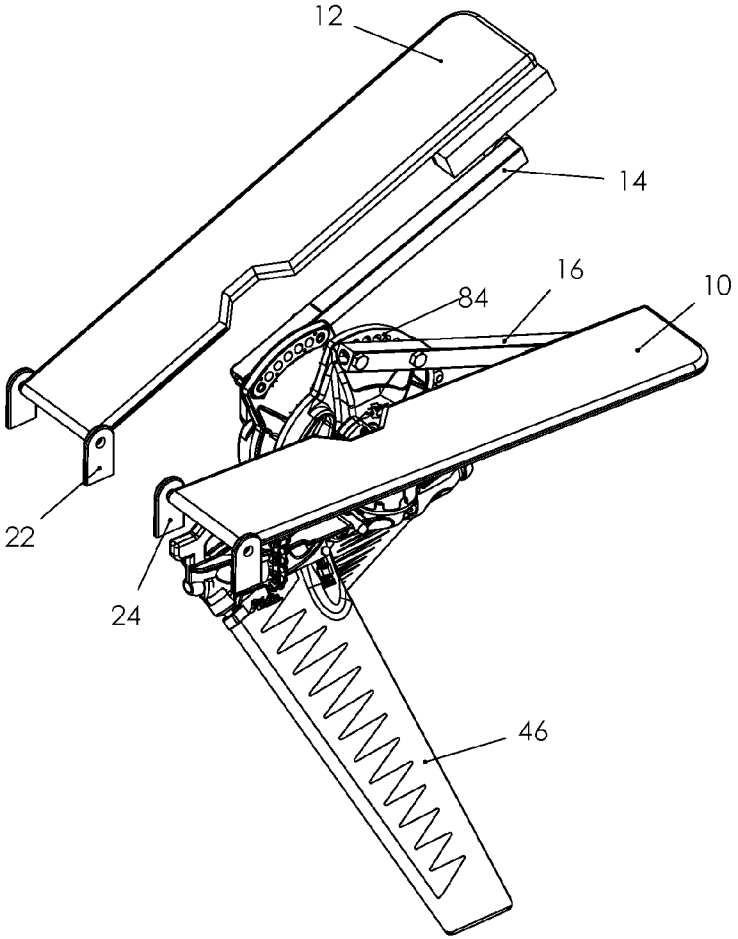
FIG. 5 is a top view from the side showing the step-stair action of the pedals.
Figure 6:
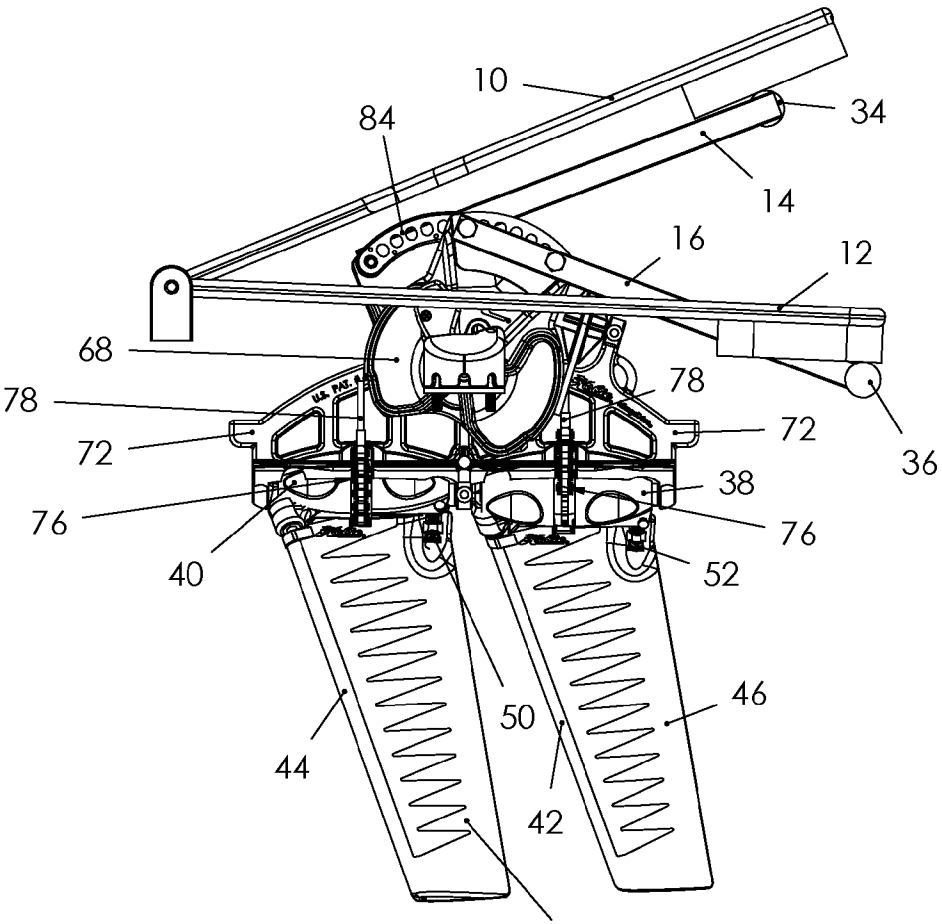
FIG. 6 is a side view showing the connection of the pedals and cranks to the flappers.
Figure 7:
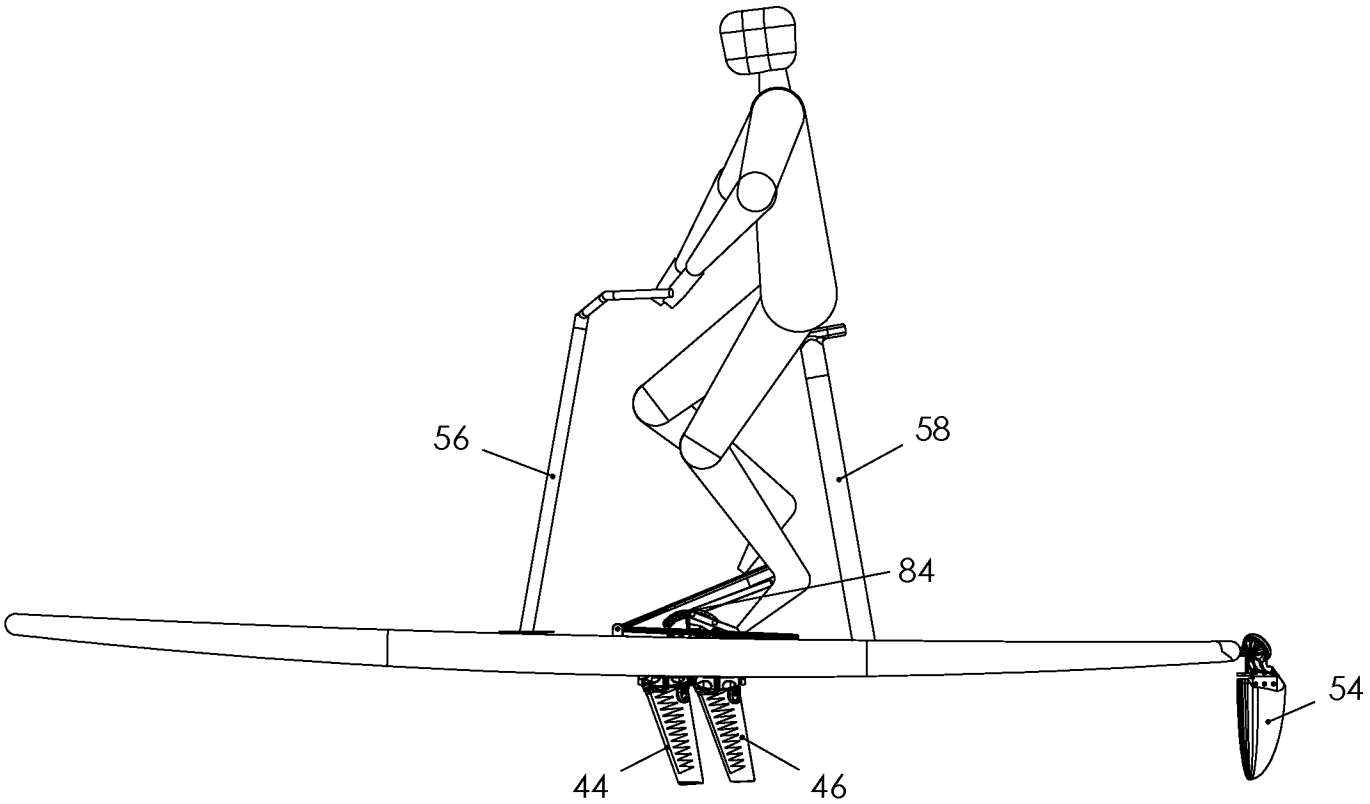
FIG. 7 is another side view of the paddle board with a rear support for the operator.
Figure 8:
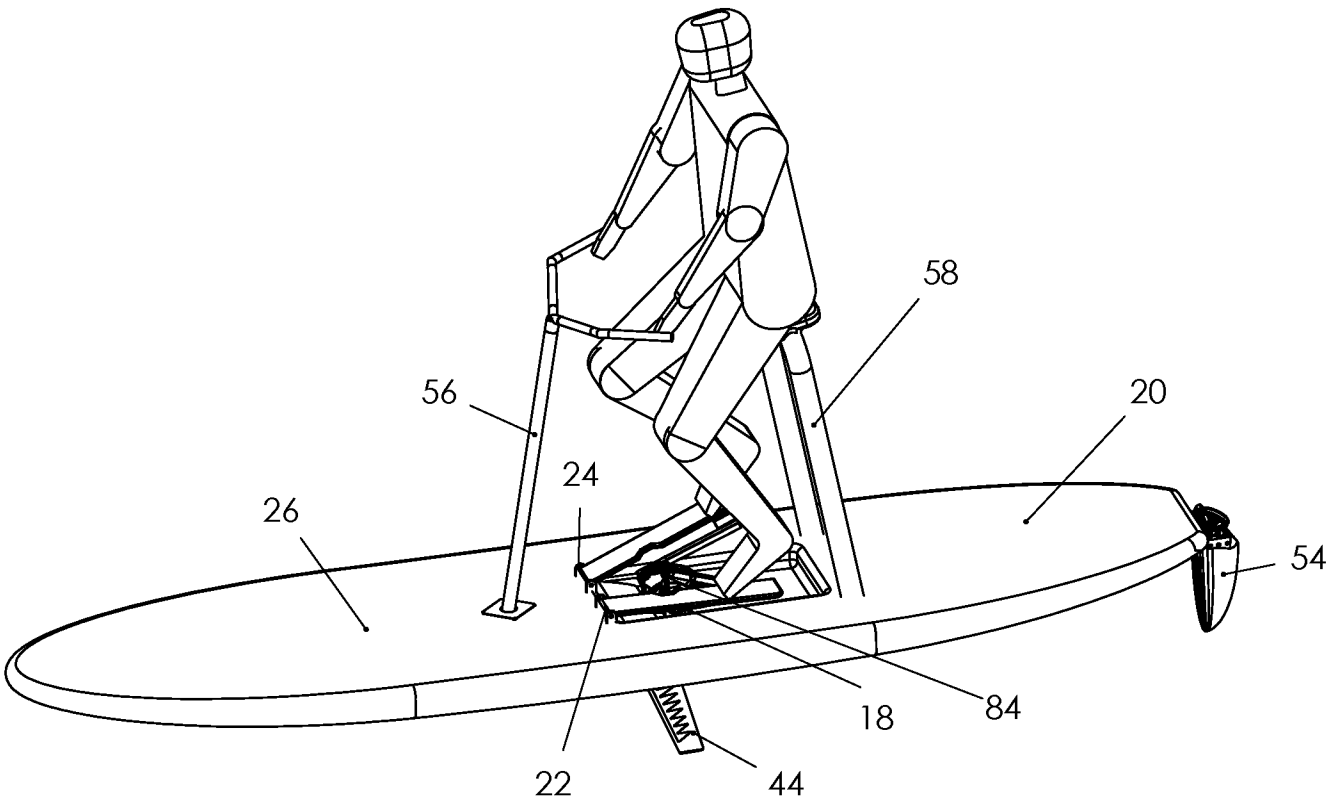
FIG. 8 is a perspective view of the paddle board of FIG. 7 showing the opening in the board with the flappers below the board.
Figure 9:
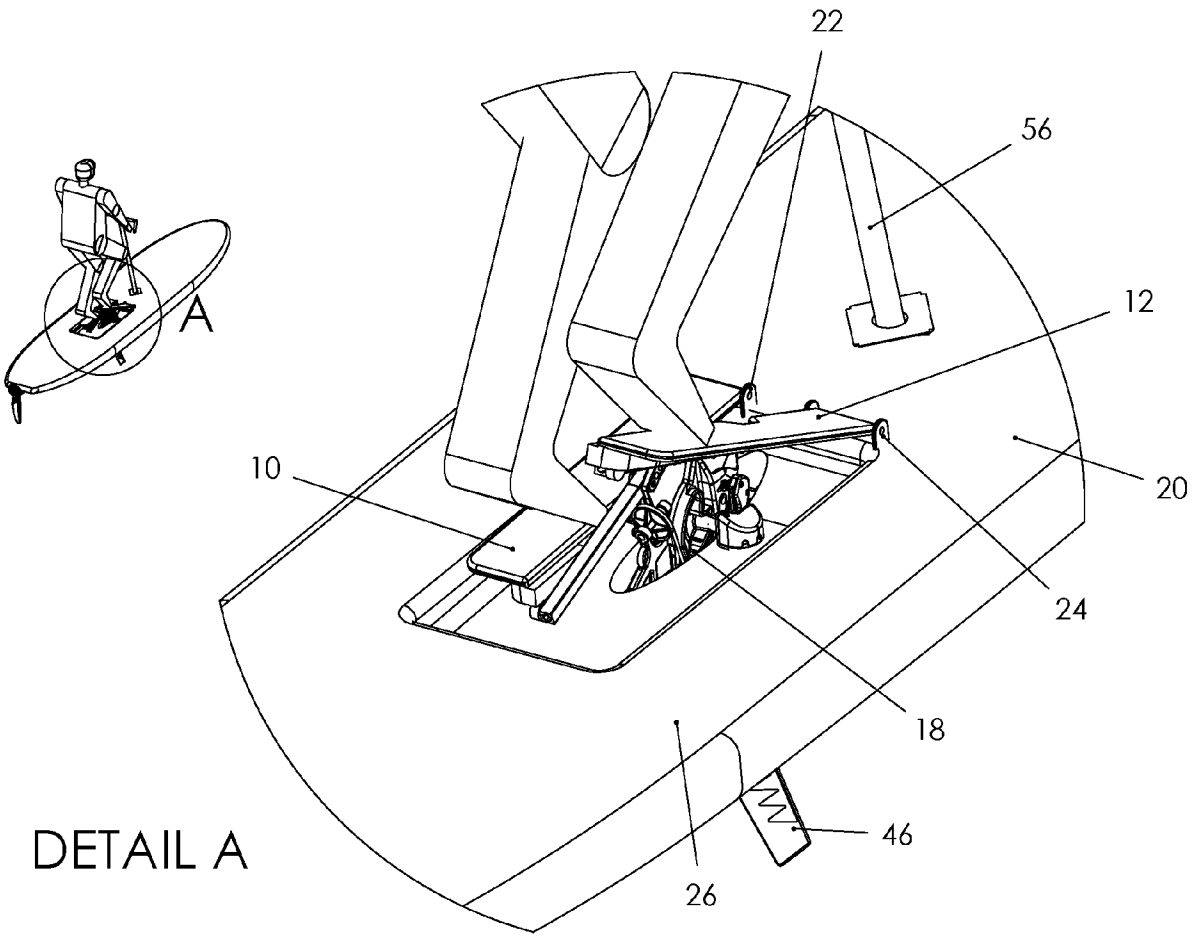
FIG. 9 is a perspective view from the upper rear showing the stair-stepping action in more details.
Figure 10:
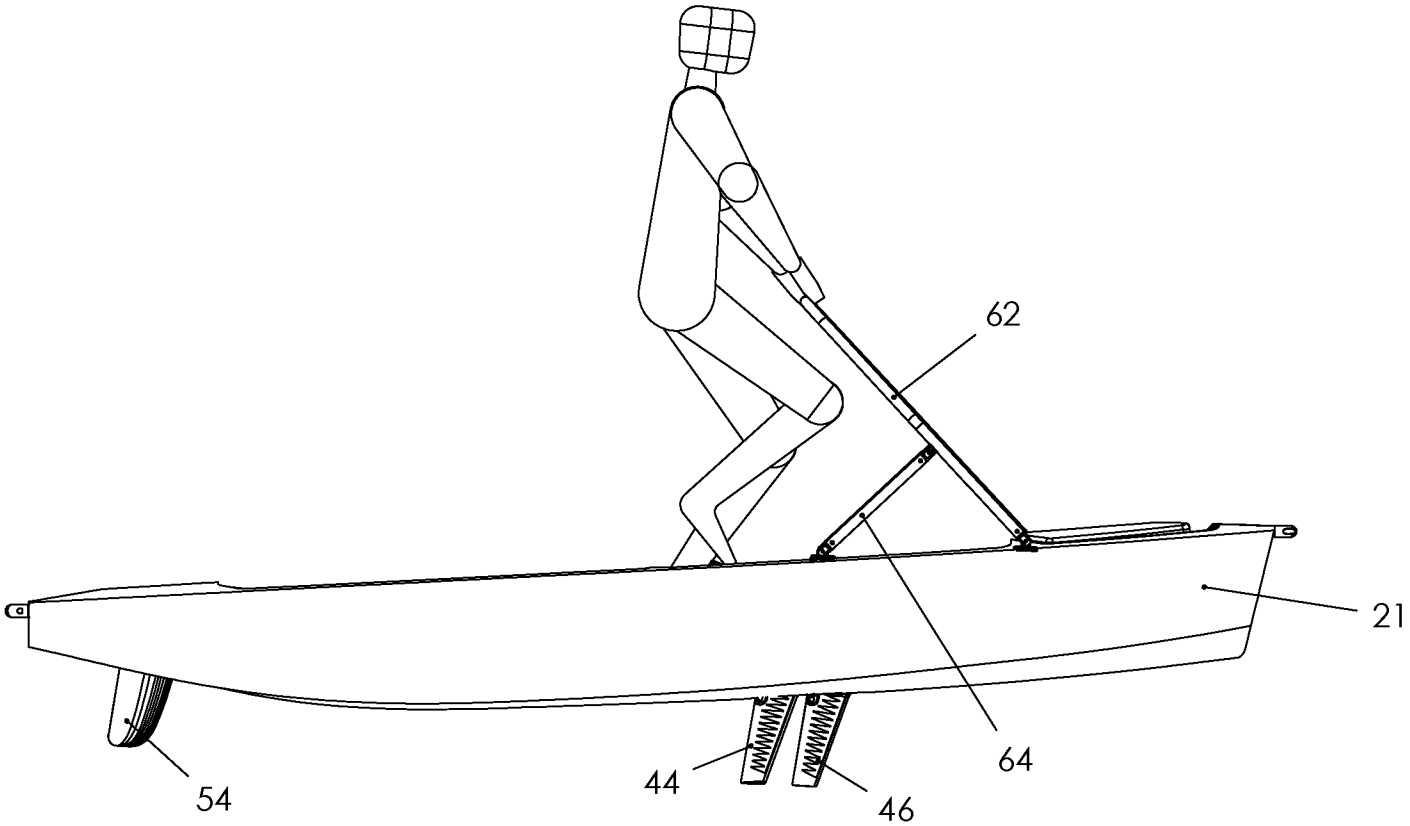
FIG. 10 is a side view of another embodiment of the invention, that is, a kayak operated from the standing position with a reasonably angled support fore of the operator.
Figure 11:
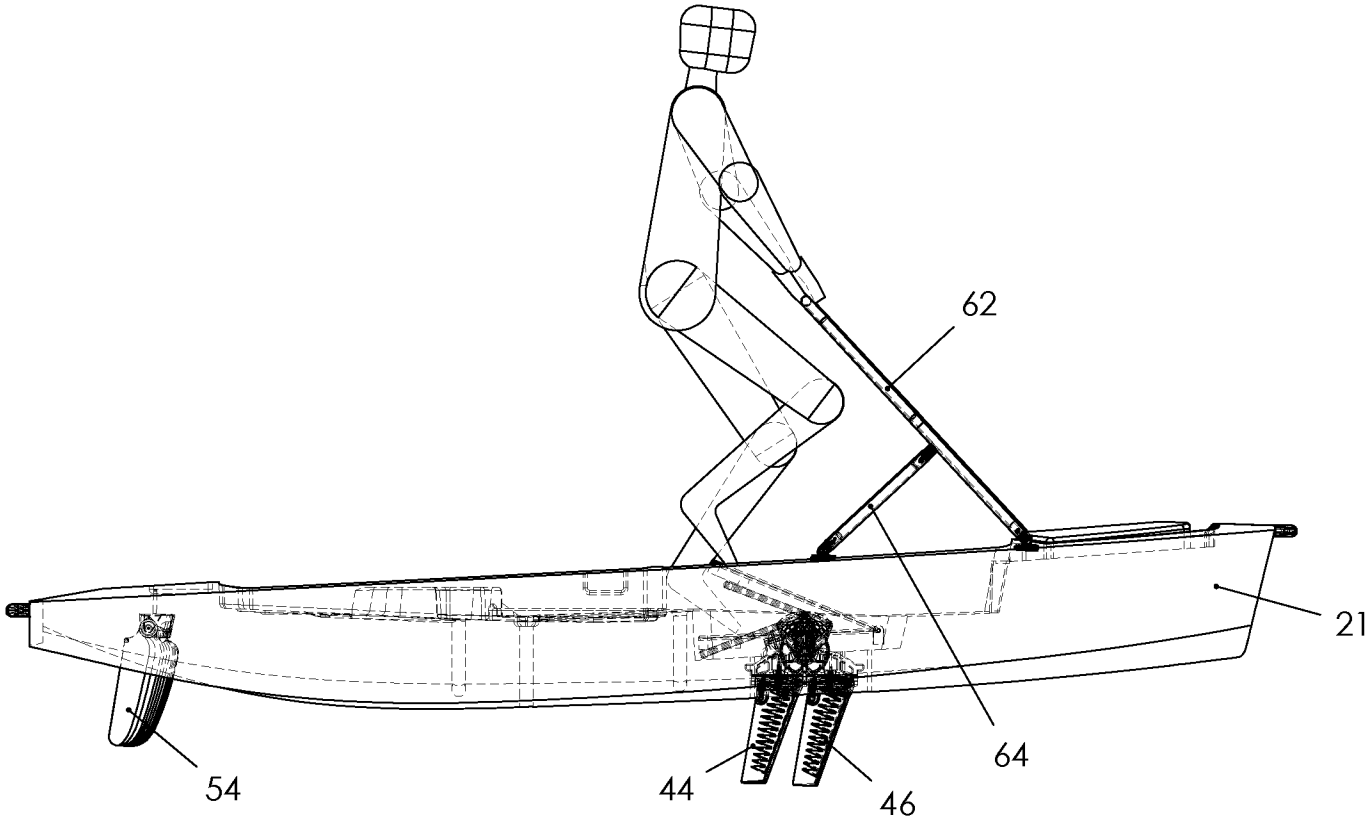
FIG. 11 is a side view as in FIG. 10 with parts omitted to reveal the relationship between the pedals and the flappers.
Figure 12:
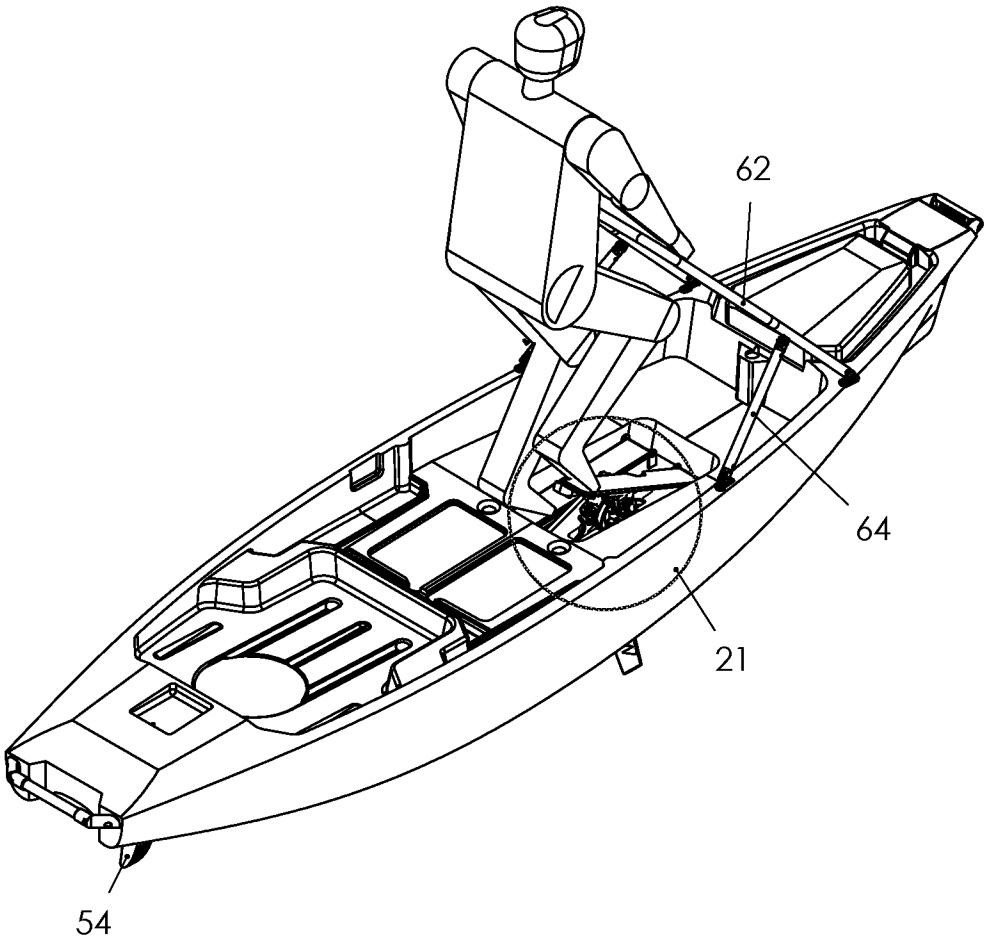
FIG. 12 is a view of the kayak and operator of FIGS. 10 and 11 from the upper rear.
Figure 13:
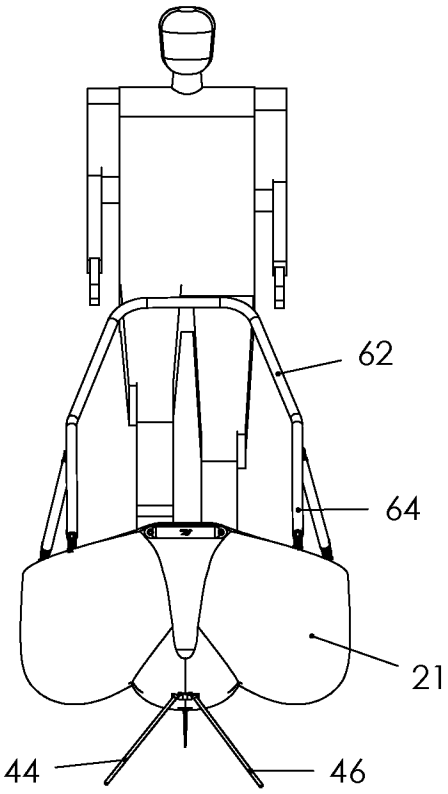
FIG. 13 is a front view of the kayak and operator of FIGS. 10 to 12.
Figure 14:
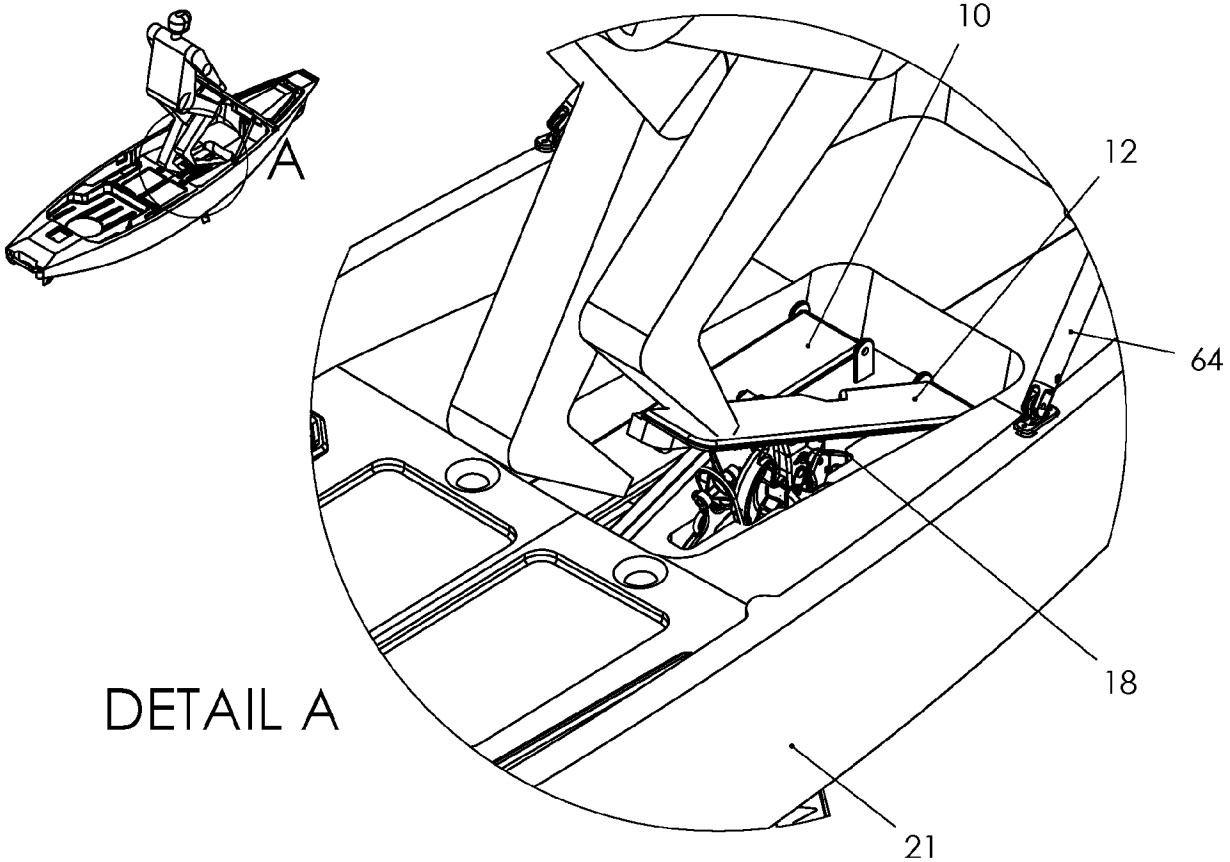
FIG. 14 is an enlarged view showing the stair step operation of the pedals in a kayak.
Figure 15:
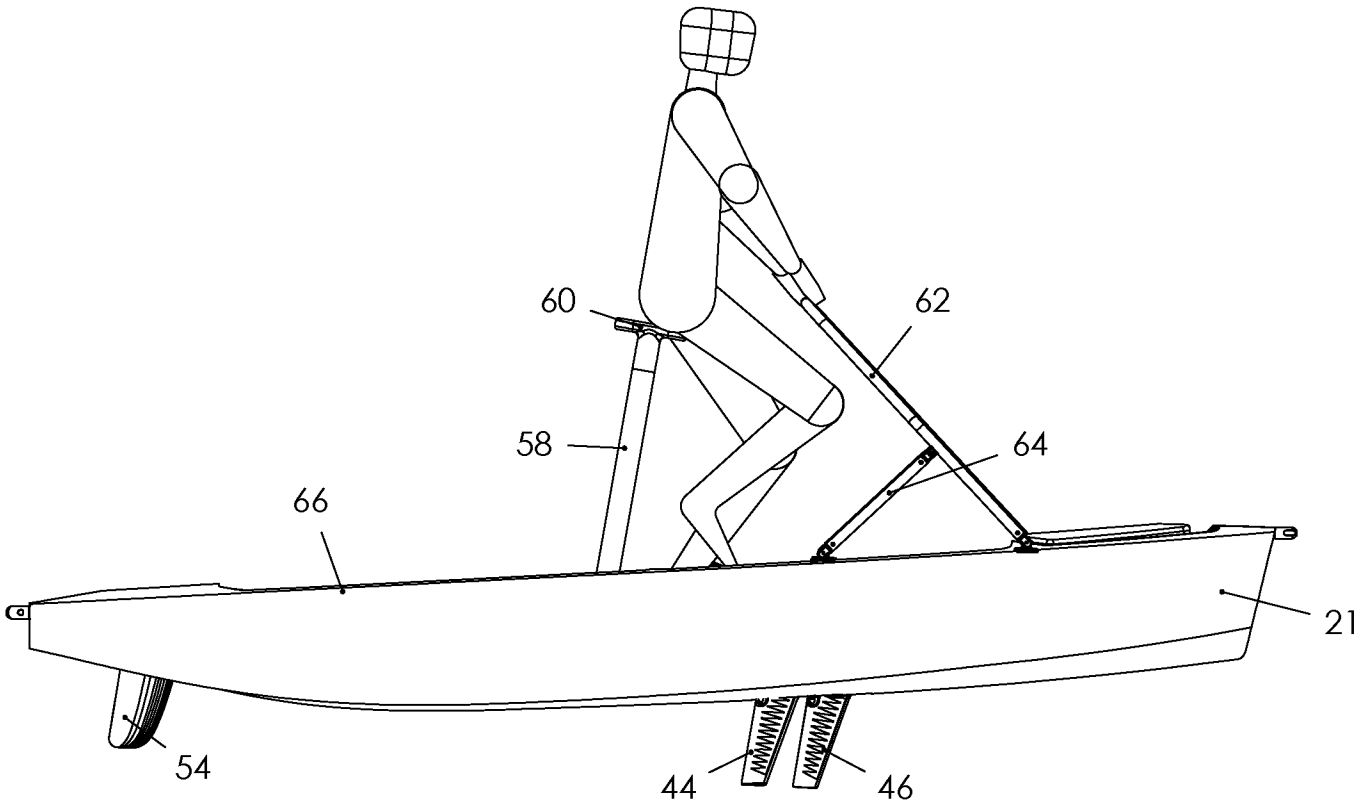
FIG. 15 shows the kayak and operator with a seat mounted on an essentially upright support.
Figure 16:
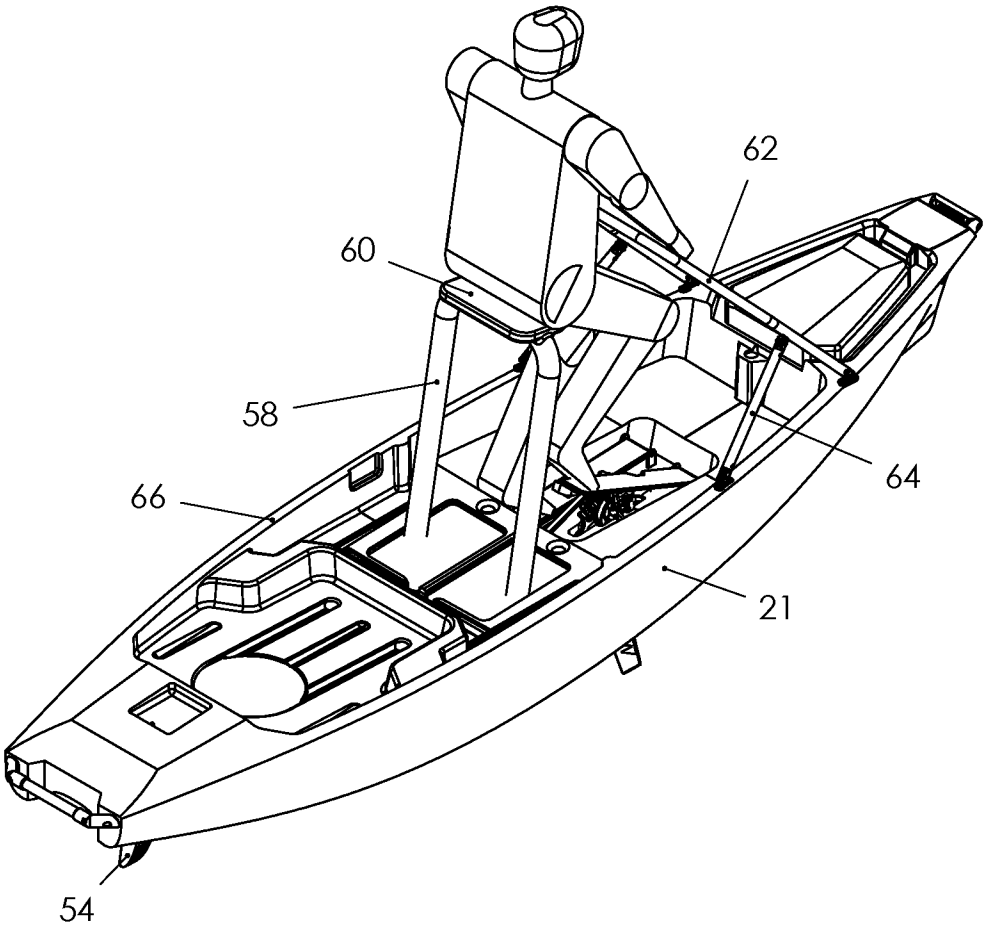
FIG. 16 shows the upright for the seat in the form of two essentially vertical members.
Figure 17:
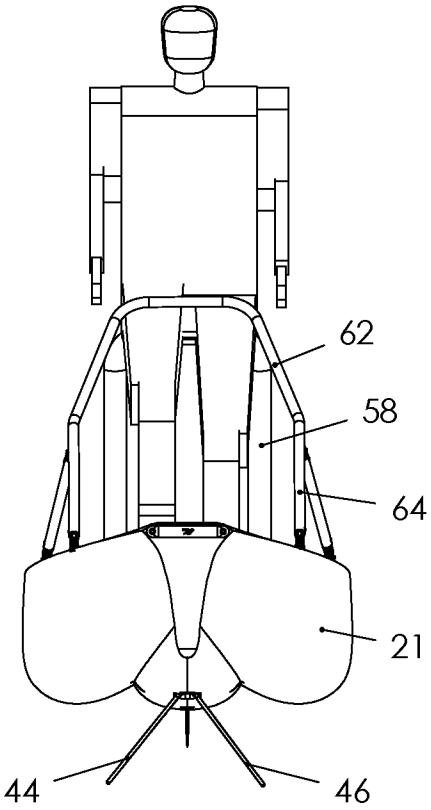
FIG. 17 is a frontal view of FIG. 16.
Figure 18:
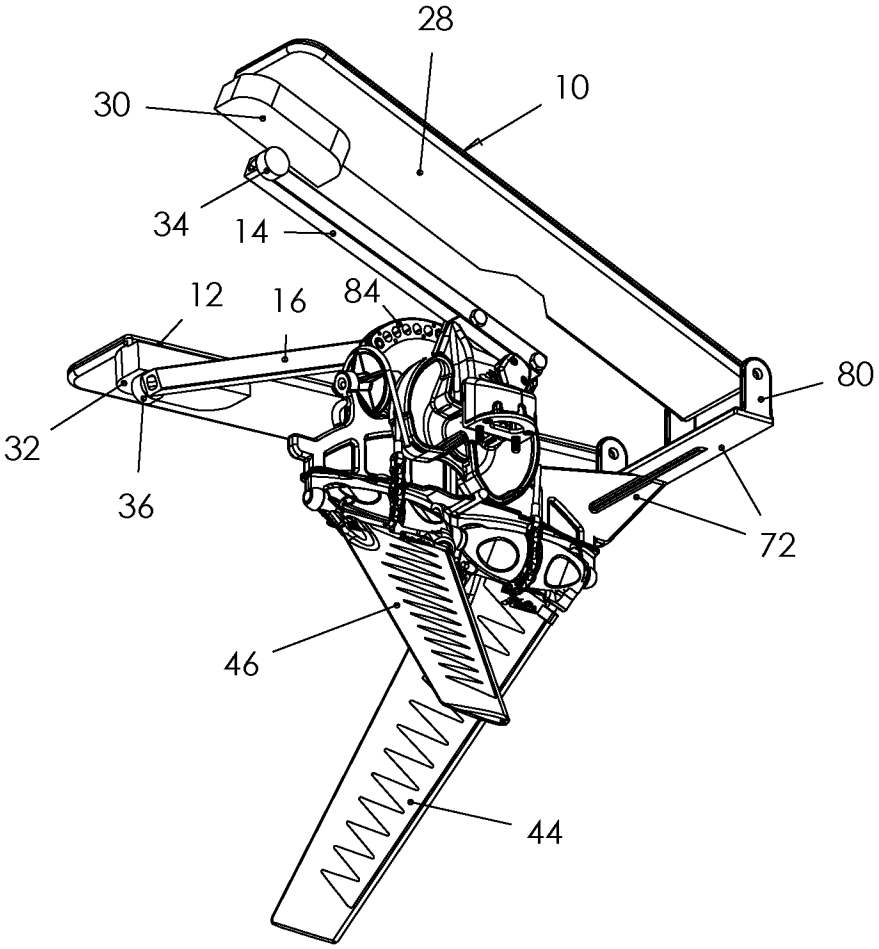
FIGS. 18 to 22 show an alternate embodiment of the invention.
Figure 19:
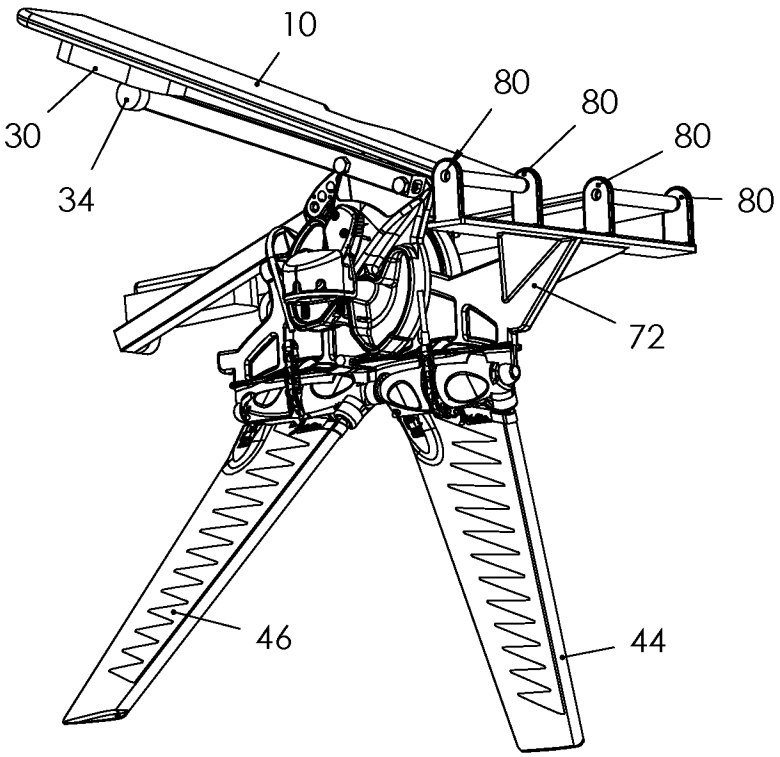

Turning to the drawings in more detail, the pedals 10 and 12 are in slidable contact with pedal cranks 14 and 16, respectively as further described hereinbelow. The pedal cranks 14 and 16 are operatively connected at member 84 to the propulsion means which is recessed in an opening 18 in the center of the paddle board 20 or kayak 21. The forward end of each of the pedals 10 and 12 are pivotally attached at 22 and 24 to the upper surface 26 of paddle board or kayak.

The underside 28 at the rear or trailing ends 30, 32 of the pedals 10 and 12 are each adapted to make rolling contact with bearings 34 and 36 attached to the free ends of the cranks 14 and 16, respectively. The underside 28 of the pedals 10 and 12 can also make sliding contact with the free ends of the cranks. The standing operator or user of the paddle board or a seated operator of a boat such as a kayak by applying step-stair movement with the legs to the pedals causes the cranks to move up and down, such that as one pedal is pressed down the other moves up.

The rotatable drums 38 and 40 carry radially extending rigid masts 42 and 44, respectively. The masts project in a generally downwardly direction so that they always remain in the water and do not contact the underside of the hull. The masts support the sails or flappers 46 and 48, respectively, at their leading edges. Each of the sails or flappers is rotatable about its mast, so that the edge of the flapper opposite the leading edge can move from one side to the other with respect to the longitudinal center line of drums 38 and 40. This action results in both flappers exerting of forward force or push on the watercraft in both directions of transverse movement of the flappers, providing superior efficiency and speed. The extent of travel or movement of the trailing edges is limited by the adjustment provided by main sheet tensioners 50 and 52.

The sail or flapper mast 42 is attached to the front of front drum 38 and second sail or flapper mast 44 is attached to the front of rear drum 40. At the rear of each sail or flapper, the main sheet tensioner connects to its respective drum and is adjustable in its reach or length to alter the tension in each of the sails or flappers 46 and 48.

Further detail regarding the structure of the drums, mast and supports are described in U.S. Pat. No. 6,022,249, the disclosure of which is expressly incorporated herein by reference.

FIGS. 10 to 17 show the invention applied to a kayak. However, the invention is applicable to small boats generally. The operator is not within a cockpit. Instead, the operator is standing or seated on a surface 60 supported by an essentially upright member or members 58. The operator is seated substantially above the upper extremity 66 of the hull of the kayak. As shown in FIGS. 7 to 10, the operator can also be seated on a paddle board.

In the kayak embodiment, the fore upright 62 is angled somewhat toward the operator for convenience and comfort and the upright can be supported by brace 64. The fore upright can be provided with a handle bar with hand grips at each end.

The paddle board or small boat, typically a kayak, is provided with a rudder 54 which can be operated from an upright 56 fore of the user.

The paddle board or kayak can also be provided with a second upright 58 to provide support for the operator or user while underway or at rest.

The pedal cranks 14 and 16 are connected to chain guides 68 carried on axle 70. The chain guides 68 can rotate back and forth on the axle 70. The axle 70 is supported by the drive support member or spine 72. It is to be understood that the support member 72 may be monolithic or, alternatively, made up of several individual components which serve the same purpose.

Drive support member or spine 72 carries longitudinal shaft 74 which carries sprockets 76. The longitudinal shaft also carries the rotatable drums 38 and 40, masts 42 and 44, and the respective flappers 46 and 48. Chains 78 connected to chain guides 68 pass over the sprockets 76 to drive the sails or flappers 46 and 48.

In the embodiment of FIGS. 18 to 22, the fore ends of pedals 10 and 12 are affixed to or near the fore end of the drive support member or spine 72 at pivot point 80.

Figure 20:
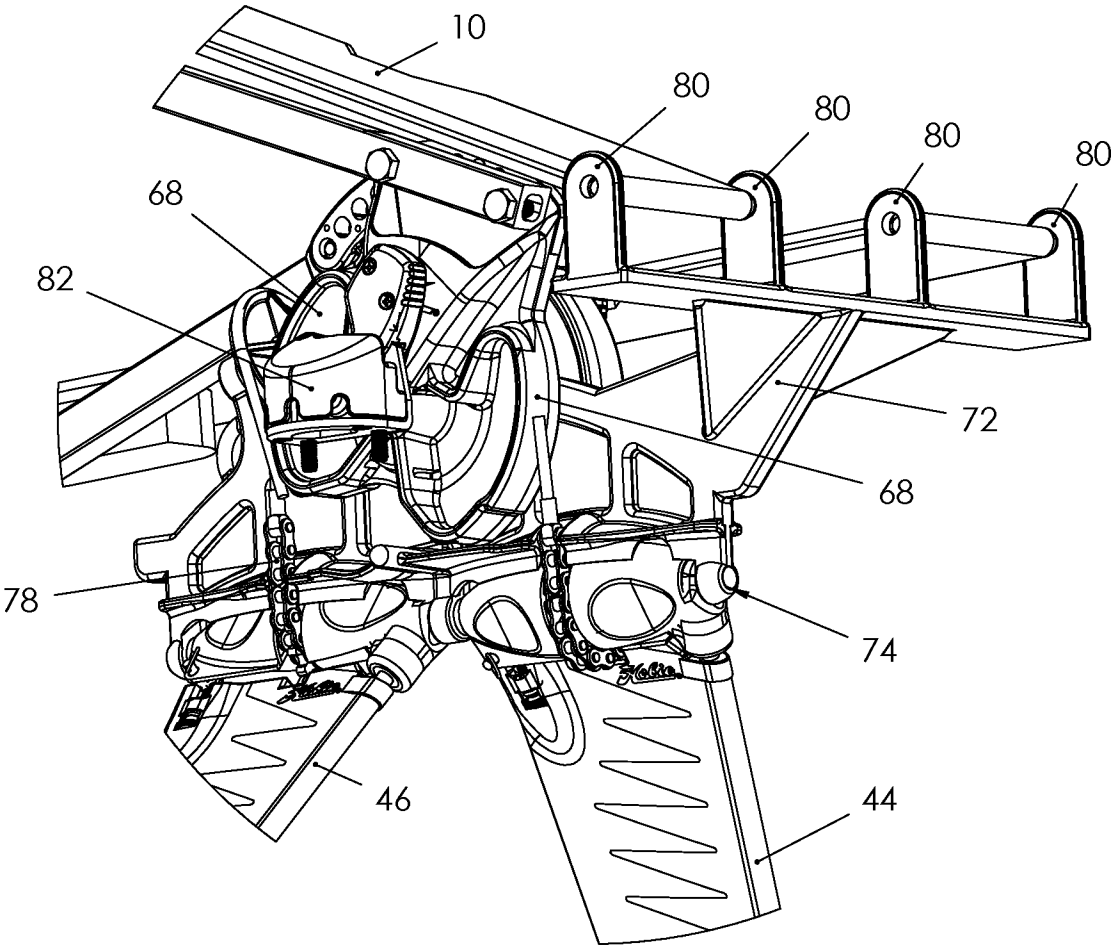
Figure 21:
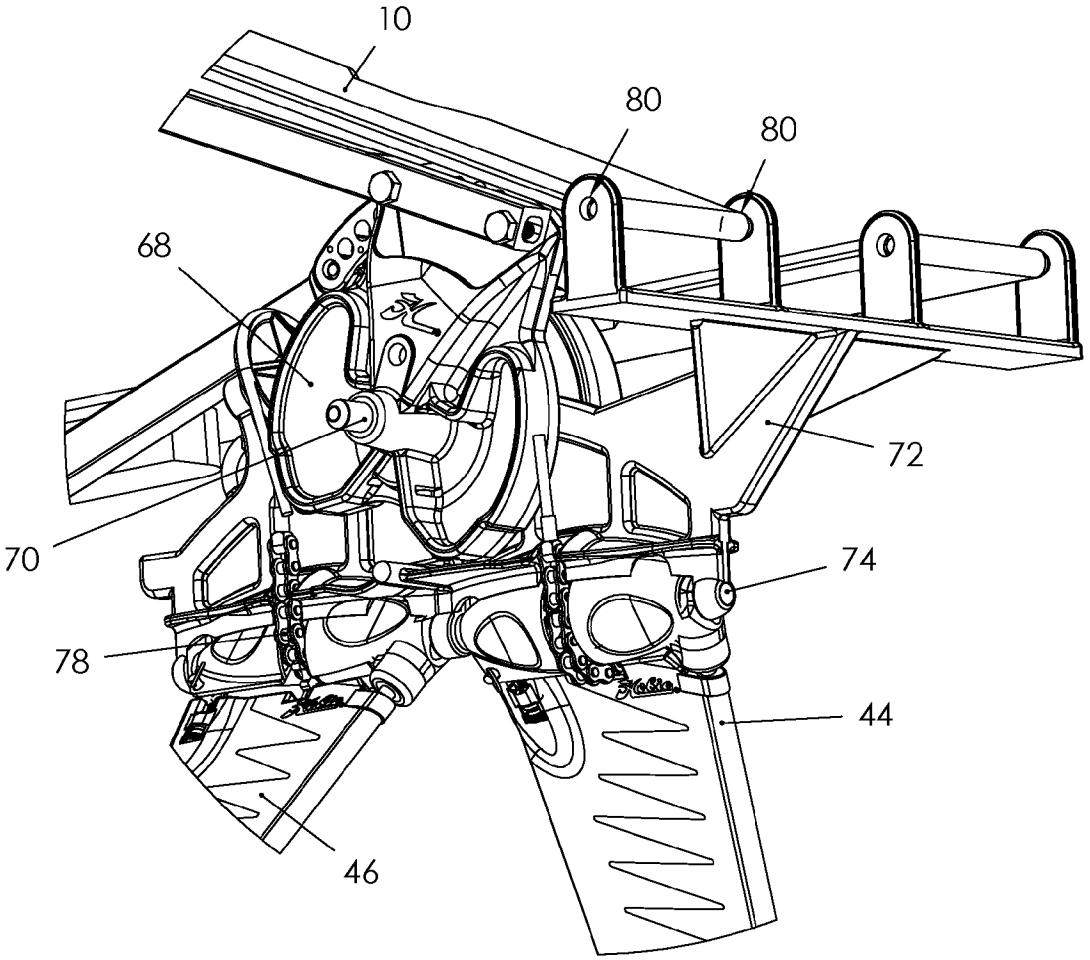
Figure 22:
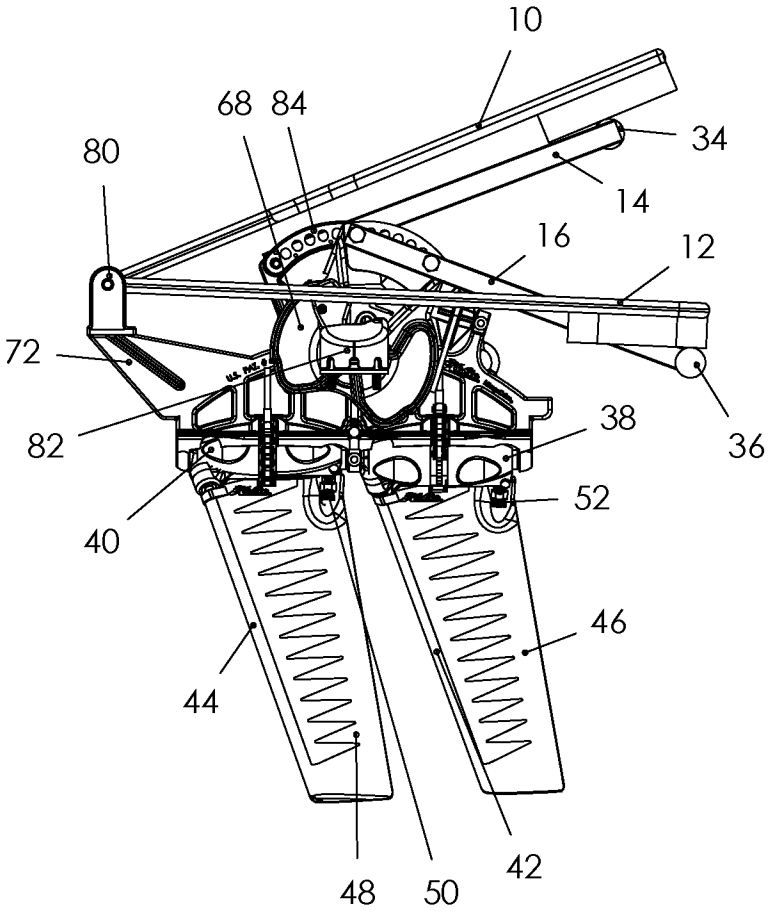

FIGS. 20 and 21 differ in that in FIG. 20, the end of axle 70 is covered by mounting element 82 which serves to secure the propulsion means to an opening in the bottom of the watercraft. The structure of mounting elements for this application are well known in the art and do not form part of this invention.

In the case of a kayak or other small boat, the seat is located substantially above the upper terminus of the hull.

In the present invention, the operator when standing on the pedals can move his weight fore and aft significantly. Moving the weight fore and aft significantly changes the mechanical advantage in the operation of the pedals.

The invention claimed is:

1. A device adapted to be inserted in a watercraft comprising propulsion means extending below the water line carried by a support member, said propulsion means comprising a pair of flexible flappers each adapted to oscillate through an arcuate path in a generally transverse plane with respect to a central longitudinal dimension of said watercraft, one flexible flapper rotating in one direction and the other flexible flapper in the opposite direction, and means operatively associated with said propulsion means for applying input force to said propulsion means whereby as input force is applied, said flexible flappers can twist to form an angle of attack for providing forward thrust with respect to the longitudinal dimension of the watercraft while moving in both directions along said arcuate path, wherein said means for applying input force comprises a pair of pedals coupled to said flexible flappers such that as one pedal moves down the other pedal moves up, the fore ends of the pedals being pivotally attached so as to pivot about an immovable essentially horizontal axis essentially perpendicular to the center line of the watercraft and the aft ends of said pedals being free to pivot about said axis whereby an operator can apply step-wise force on the pedals.

2. A device adapted to be inserted in a watercraft comprising propulsion means extending below the water line carried by a support member, said propulsion means comprising a pair of flexible flappers each adapted to oscillate through an arcuate path in a generally transverse plane with respect to a central longitudinal dimension of said watercraft, and means operatively associated with said propulsion means for applying input force to said propulsion means whereby as input force is applied, said flexible flappers can twist to form an angle of attack for providing forward thrust with respect to the longitudinal dimension of the watercraft while moving in both directions along said arcuate path, wherein said means for applying input force comprises a pair of pedals, and further including pedal cranks operatively associated with said propulsion means, the fore ends of the pedals being pivotally attached about a fixed point on an upper surface of a watercraft and the aft ends of said pedals being free to make rolling or sliding contact with said pedal cranks whereby an operator can apply force to the pedal cranks by applying step-wise force on the pedals.

3. A device adapted to be inserted in a watercraft, said device comprising propulsion means extending below the water line carried by a support member, said propulsion means comprising a pair of flexible flappers each adapted to oscillate through an arcuate path in a generally transverse plane with respect to a central longitudinal dimension of said watercraft, and means operatively associated with said propulsion means for applying input force to said propulsion means whereby as input force is applied, said flexible flappers can twist to form an angle of attack for providing forward thrust with respect to the longitudinal dimension of the watercraft while moving in both directions along said arcuate path, wherein said means for applying input force comprises a pair of pedals, and further including pedal cranks operatively associated with said propulsion means, the fore ends of the pedals being pivotally affixed to an upper surface of said watercraft and the aft ends of said pedals being free to make rolling or sliding contact with said pedal cranks whereby an operator can apply force to the pedal cranks by applying step-wise force on the pedals.

4. A novel watercraft having propulsion means extending below the water line carried by an immovable support member, said propulsion means comprising a pair of flexible flappers each adapted to oscillate through an arcuate path in a generally transverse plane with respect to a central longitudinal dimension of said watercraft, and means operatively associated with said propulsion means for applying input force to said propulsion means whereby as input force is applied said flexible flappers can twist to form an angle of attack for providing forward thrust with respect to the longitudinal dimension of the watercraft while moving in both directions along said arcuate path wherein said means for applying propulsive force comprises a pair of pedals, and further including pedal cranks operatively associated with said propulsion means, the fore ends of the pedals being pivotally affixed to said immovable support member and the aft ends of said pedals being free to make rolling or sliding contact with said pedal cranks whereby an operator can apply force to the pedal cranks by applying step-wise force on the pedals.

5. The watercraft of claim 4 wherein the watercraft is a paddle board.

6. The paddle board of claim 5 where a stationary upright is provided fore of the operator for grasping while pedaling.

7. The paddle board of claim 5 wherein a seat is provided aft of the operator.

8. The watercraft of claim 4 wherein the watercraft is a small boat.

9. The small boat of claim 8 wherein a stationary upright is provided fore of the operator for grasping while pedaling.

10. The small boat of claim 8 wherein a seat is provided aft of the operator, the seat being substantially above the upper extremity of the hull of the boat.

11. The watercraft of claim 4 wherein the watercraft is a kayak.

12. The kayak of claim 11 wherein a stationary upright is provided fore of the operator for grasping while pedaling.

13. The kayak of claim 11 wherein a seat is provided aft of the operator, the seat being substantially above the upper extremity of the hull of the kayak.

* * * * *